US006819059B2

(12) United States Patent
Block et al.

(10) Patent No.: US 6,819,059 B2
(45) Date of Patent: Nov. 16, 2004

(54) FLASH STROBE POWER SUPPLY SYSTEM AND METHOD

(75) Inventors: Tilton L. Block, Frankfort, IL (US); Joseph M. Allison, Euclid, OH (US)

(73) Assignee: Federal Signal Corporation, University Park, IL (US)

( * ) Notice: Subject to any disclaimer, the term of this patent is extended or adjusted under 35 U.S.C. 154(b) by 65 days.

(21) Appl. No.: 10/282,943

(22) Filed: Oct. 29, 2002

(65) Prior Publication Data

US 2004/0080282 A1 Apr. 29, 2004

Related U.S. Application Data

(63) Continuation-in-part of application No. 10/281,077, filed on Oct. 25, 2002, now abandoned.

(51) Int. Cl.[7] ..... H05B 37/00

(52) U.S. Cl. ..... 315/241 S; 315/194; 315/292; 315/293; 323/212; 363/21.12

(58) Field of Search ..... 315/77, 194, 209 SC, 315/241 S, 241 R, 255, 276, 246, 229, 272, 279, 291–293, 297; 323/212, 215, 277, 282; 363/21.12, 21.14, 89

(56) References Cited

U.S. PATENT DOCUMENTS 4,388,559 A * 6/1983 Lefavour ..... 315/78
4,613,797 A 9/1986 Eggers et al.
4,920,301 A 4/1990 Crooks
5,015,918 A * 5/1991 Copeland ..... 315/76
5,189,344 A 2/1993 Rose
5,691,696 A * 11/1997 Mazies et al. ..... 340/471
5,785,413 A * 7/1998 Tillinghast et al. ..... 362/228

OTHER PUBLICATIONS

Joe Allison; ric.asm; Mar. 11, 2002; 37 pages.

* cited by examiner

*Primary Examiner*—Haissa Philogene
(74) *Attorney, Agent, or Firm*—Leydig, Voit & Mayer, Ltd.

(57) ABSTRACT

A reliable strobe power supply is disclosed that provides requisite light energy for emergency uses without causing EMI problems. A two phase dual flyback power converter operating in transitional mode is disclosed containing a microcontroller that maintains a 180 degree displacement between the two phases by enabling a small, variable dead time between the cessation of stored energy in the flyback transformers and turn-on of the associated power switching transistor for one or the other phases. The power supply is capable of detecting a fault (neoning) and automatically correcting the condition by incrementing the flash capacitor charge off-time delay. The power supply is also capable of tolerating defective (persistently neoning) strobe tubes that cause an inordinate delay in capacitor charging by turning them off.

16 Claims, 6 Drawing Sheets

FLASH STROBE POWER SUPPLY SYSTEM AND METHOD

CROSS REFERENCE TO RELATED PATENT APPLICATION

This is a continuation-in-part of U.S. patent application Ser. No. 10/281,077, entitled "FLASH STROBE POWER SUPPLY SYSTEM AND METHOD" filed Oct. 25, 2002 now abandoned, by the same inventors, and is incorporated herein in its entirety by reference.

FIELD OF THE INVENTION

The present invention relates generally to power supplies, and, more particularly, relates to strobe tube power supplies.

BACKGROUND OF THE INVENTION

Emergency vehicles such as fire trucks, police vehicles and ambulances rely on sirens and lights to warn civilians and to protect traveling emergency personnel. Strobe lights have higher intensity than ordinary lights and are preferred for emergency vehicle applications. The exigent circumstances of an emergency situation dictate that the sirens and lights on emergency vehicles operate efficiently, reliably and without delay.

Strobe lights require an energy storage capacitor, e.g., a flash capacitor, to produce flash patterns. To charge the flash capacitor to produce a flash pattern, strobe lights typically implement a strobe power supply comprising power switching transistors and other electrical components. Flash capacitors are coupled to a strobe power supply that is installed between one or more flash tubes and a power source. The power supply, flash capacitor and gas-filled strobe tubes cooperate to produce flashes of light. The flash capacitor and strobe tubes are connected directly to each other—in a parallel circuit arrangement. In common practice, a flash capacitor is charged to a voltage below the ionization voltage of the gas in the tube; the gas remains de-ionized and electrically non-conductive until triggered. To trigger a flash, a relatively high voltage pulse applied to a wire wrapped around the tube initiates ionization of the gas. The charge on the capacitor then completes the ionization, rendering the tube electrically conductive and causing the capacitor to discharge into the ionized gas. The flash capacitor discharging produces the flash. After the capacitor has discharged, the gas de-ionizes provided the charging current from the power supply is turned off for a sufficient time after the discharge. To produce a next flash, the flash capacitor is recharged and the trigger reapplied. Since the capacitor and tube are connected in parallel, a means must be provided to hold off charging current into the flash capacitor for a sufficient time immediately following a flash. Otherwise, charging current will flow into the tube instead of the capacitor—as the tube remains electrically conductive; the charging current will sustain the ionization and the tube will remain electrically conductive until the charging current is turned off for a sufficient time. This diversion of the charging current away from the capacitor and into the tube keeps the capacitor from charging, thereby disabling the flash system. This fault condition is called, "neoning". The term, neoning, derives from the fact that the tube glows dimly, like a neon tube, when provided with a sustained current. The light output from such a neoning strobe tube is inadequate for any practical purpose. Furthermore, just one neoning tube diverts all of the available charging current thereby disabling an entire system of multiple tubes connected to a common strobe power supply.

The time needed to de-ionize a tube following a flash is not a well-quantified parameter. Rather, the time varies with tube gas pressure and other ill-quantified phenomena. As a tube ages, the propensity to neon increases due to reduced gas pressure caused by leakage at the tube seals. All too often, a defective (neoning) tube disables an entire system of multiple tubes. A method of automatically isolating and effectively disconnecting a neoning tube is highly desirable because such method would keep a system operating even with one or more defective (neoning) tubes.

Given the considerations of emergency vehicles, what is needed is a power supply for strobe lights that is tolerant of defective strobe tubes and provides the requisite light energy for emergency uses. When the power requirement is for more than 60-watt, it is desirable to have a method of synchronizing the switching cycles of dual power converters operating in transitional mode to maintain 180-degrees of phase displacement between the converters.

BRIEF SUMMARY OF THE INVENTION

In light of the above, it is a general aim of the present invention to provide a reliable strobe power supply that provides requisite light energy for emergency uses without causing EMI problems. A dual flyback power converter operating in transitional mode is disclosed that includes a programmable control circuit configured to operate each of the converter's power switching transistors in response to circuits that enable a small dead time between the cessation of stored energy in the flyback transformers and turn-on of the associated transistor via synchronization code in the programmable control circuit that periodically delays turn on of one or the other transistor to maintain a 180 degree relationship between the two phases.

The power supply is also capable of detecting a fault (neoning) condition in a system of strobe tubes by measuring flash capacitor voltage subsequent to a flash and identifying a neoning condition as a state in which the flash capacitor voltage fails to increase after 10 mS of flash capacitor charging.

The power supply is also capable of automatically correcting a fault (neoning) condition by incrementing the flash capacitor charge off-time delay to the off-time delay needed to prevent a fault (neoning) condition.

The power supply is also capable of tolerating defective (persistently neoning) strobe tubes that cause an inordinate delay in capacitor charging in a system by first identifying the defective strobe tubes by individually firing each strobe tube in the system, determining an anti-neon off-time delay suitable for the individual strobe tubes, identifying whether any strobe tube is causing an inordinate delay in capacitor charging; then turning off any such identified strobe tubes.

One embodiment is directed to a strobe power supply that includes an input filter, a programmable control circuit coupled to the input filter, a first and second transistor operatively coupled to the programmable control circuit, a first and second transformer, each transformer operatively coupled to one of the first and second transistors, and two circuits configured to sense an energy state, such as a current state or voltage state of each transformer, the circuits are coupled to the programmable control circuit. The programmable control circuit is configured to operate each transistor in response to at least one of the circuits to provide a small, variable dead time between the cessation of stored energy in the transformers and turn-on of the associated transistor via synchronization code in the programmable control circuit, the synchronization code periodically delaying turn-on of one or the other transistor to maintain a 180 degree phase difference between switching cycles of the first and second transistors. The 180 degree relationship reduces ripple current in the input filter. The programmable control circuit can be configured to provide switching cycle signals to the first and second transistors, the switching cycle signals according to a logical function applied to a combination of turn on commands, the logical function allowing only the later command of a measured synchronizing turn on and a normal turn on for the first transistor to be an operative turn on, the synchronizing turn on command enabling synchronization of the turn on of the first transistor with a phase displaced turn on of the second transistor. In one embodiment, the logical function is equivalent to AND-ing of the turn on commands.

In one embodiment, the strobe power supply includes at least two isolating circuits coupled to the programmable control circuit. Each of the isolating circuits can include a voltage divider configured to provide a voltage measurement of a flash capacitor and to provide for a voltage limiting function for a flash lamp.

One embodiment is directed to operating two power converters in two phases with transitional conduction mode for a strobe power supply. The method includes periodically introducing a small dead time to the higher frequency power converter to maintain a constant phase angle displacement between the two phases. In one embodiment of a two-phase power supply, the method includes adjusting the two phases to a displacement of 180 degrees at least once every six power cycles of the combined converters. The method also includes measuring a period of a phase according to a time between each turn on of a transistor in at least one of the power converters and dividing the measured period by two. A final embodiment is directed to a method for synchronizing phases of a dual power converter in a strobe power supply. The method includes measuring the period of a first phase of the dual power converter then dividing the period by two to obtain the half-period, waiting for the half-period of time, issuing a turn on command, and AND-ing the turn on command with a turn on command for the second phase of the dual power converter. The period measurement, dividing by two, and half-period wait followed by application of the synchronizing turn on command can occur every fourth cycle of each phase.

The programmable control circuit can apply a logical function such as AND-ing to a combination of turn on commands, the logical function allowing only the later command of a measured synchronizing turn on and a normal turn on for a first transistor to be an operative turn on, the synchronizing command enabling synchronization of the turn on of the first transistor with a phase displaced turn on of a second transistor in a out of phase power converter. The periodic introduction of dead time can be determined via an external interrupt service routine including a first external interrupt occurring at a cessation of secondary current for a first power converter and a second external interrupt occurring at a cessation of secondary current for a second power converter, the first and second external interrupts identifying the corresponding transistor to turn on. The first and second external interrupts and a flags variable can determine which cycle of the six-cycle synchronization cycle of the two power converters is enabled.

One embodiment is directed to a method for detecting a neoning condition in a strobe power supply. The method includes measuring flash capacitor voltage subsequent to a flash and identifying a neoning state when the flash capacitor voltage fails to increase by a predetermined amount after 10 mS of flash capacitor charging. If neoning is identified, the method includes incrementing an anti-neon off-time delay by a predetermined amount, immediately turning off a charge current for the incremented delay time, after the incremented delay time, turning on the charge current, and after a predetermined amount of on time, rechecking the flash capacitor voltage. If the flash capacitor voltage rises, the method includes applying the incremented delay time to each subsequent flash; and if a predetermined failure delay time is reached, applying a diagnostic sequence to identify and remove defective strobe tubes.

One embodiment is directed to a system for diagnosing and correcting neoning in a strobe tube power supply. The system includes a programmable control circuit configured to operate computer code. The computer code includes an anti-neon off-time delay variable configured to store a value capable of being incremented by a predetermined delay time, an output from the programmable control circuit configured to supply a charge current to one or more flyback converters within the strobe tube power supply, the programmable control circuit configured to turn off the charge current for the time equivalent of the value stored in the off time delay variable, and one or more flash capacitors coupled to the flyback converters. The programmable control circuit can be configured to test one or more voltages of the one or more flash capacitors, the code within the programmable control circuit configured to determine whether any flash capacitor voltage has failed to increase, the failure indicative of a neon condition, the programmable control circuit configured to respond to the failure by increasing the value stored in the off-time delay variable. The two flyback converters can be operated out of phase by 180 degrees, the programmable control circuit being configured to maintain the 180 degree phase difference between the two flyback converters.

One embodiment is directed to a method for tolerating defective (persistently neoning) strobe tubes that cause an inordinate delay in capacitor charging in a system by first identifying the defective strobe tubes by individually firing each strobe tube in the system, determining an anti-neon off-time delay suitable for the individual strobe tubes, identifying whether any strobe tube is causing an inordinate delay in capacitor charging; turning off any such identified strobe tubes; and determining an anti-neon off-time delay suitable for the remaining strobe tubes. The method includes selecting a flash tube from a list of active flash tubes within the system, testing the selected flash tube to determine a delay for the selected flash tube or to turn off the selected flash tube, repeating the testing for each flash tube in the list of active flash tubes, and removing turned off flash tubes from the list of active flash tubes, the list of active flash tubes stored in a programmable control circuit. Prior to selecting the flash tube, an embodiment of the method includes incrementing a system delay time until a voltage for a flash capacitor within the flash strobe power supply system rises, and resetting the system delay time to a start-up value. The testing includes operating the flash tube to determine a required delay for the selected flash tube, if the required delay is over a predetermined limit, turning off the selected flash tube and removing the selected flash tube from the list of active flash tubes within the system, and if the required delay is within the predetermined limit, selecting another flash tube from the list of active flash tubes.

In one embodiment, a programmable control circuit performs the comparing, identifying, turning off and determining of the delay time.

A final embodiment is directed to a method for synchronizing phases of a dual power converter in a flash strobe power supply. The method includes dividing a period of a first portion of the dual power converter and obtaining a predetermined period of time relative to 180 degrees, waiting for the predetermined period of time, issuing a turn on command, and AND-ing the turn on command with a turn on command for the second portion of the dual power converter. The predetermined period of time can be a half period, and the dividing can occur every fourth cycle of each phase.

Other objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. In the drawings.

Figure 1A:
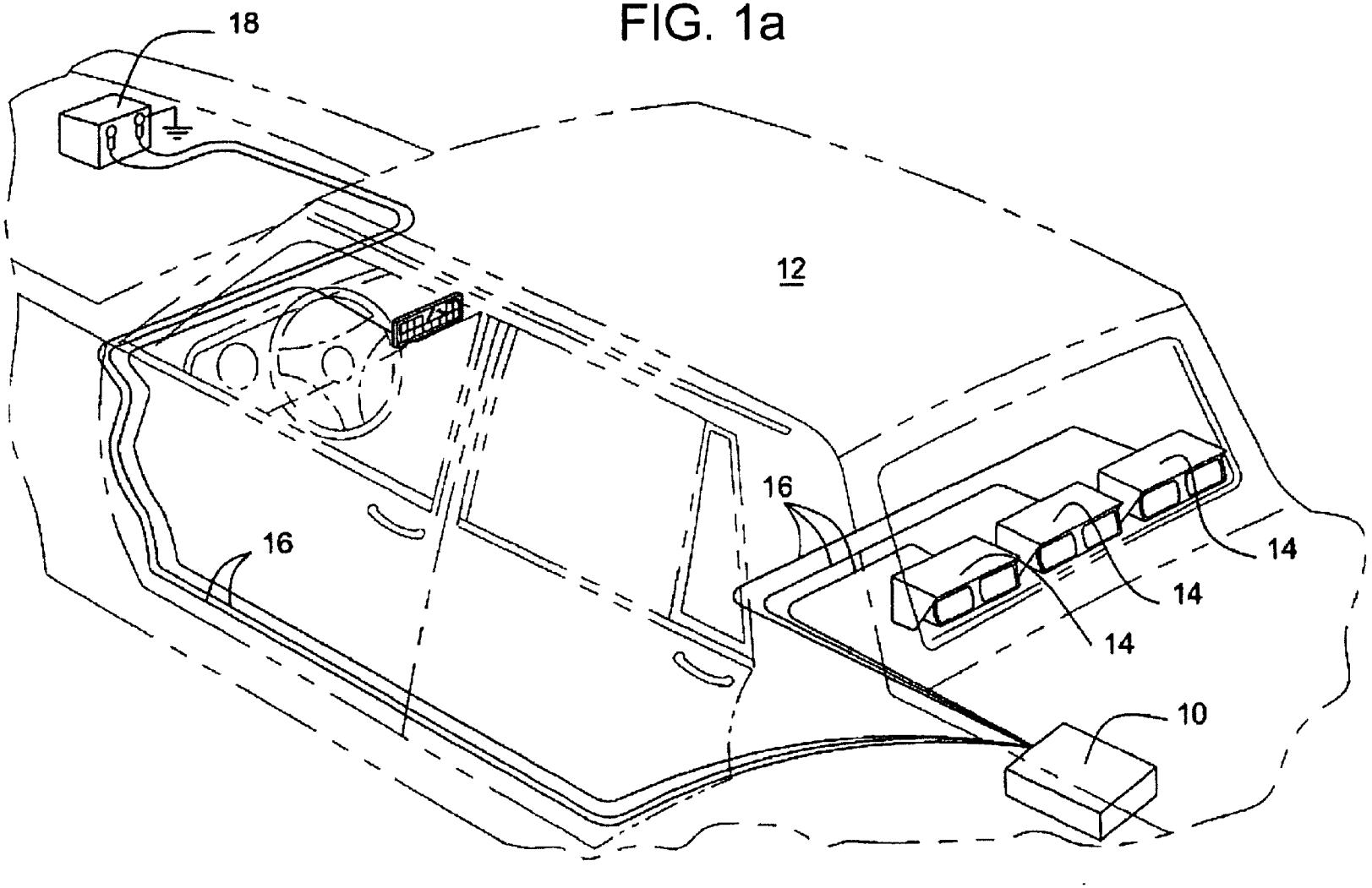
FIG. 1A illustrates an emergency vehicle appropriate for a flash strobe power supply according to one or more embodiments of the present invention.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

The light energy in a single flash is substantially proportional to the capacitance of the capacitor and the square of the capacitor voltage at the instant of triggering. The visibility of a brief exposure to light is substantially proportional to the total light energy of the exposure. Longer duration of exposure requires less peak energy to achieve the same total energy and theoretically the same visibility. Due to the persistence of vision, visual response to a rapid enough series of exposures is theoretically visibly equivalent to a single exposure of the same total energy. When impulses of light are spaced closer than 100 mS in a series of impulses, the series is considered to be a single flash for purposes of meeting a flash energy specification. The strobe power supply design is typically more practical using a rapid series of lower energy light impulses for each flash as opposed to a single light impulse for each flash. The use of rapid series flashes is the established best practice for emergency vehicle applications.

Strobe lights in vehicles require a DC-to-DC power conversion to boost the vehicle battery voltage which is typically 12-volts, to the flash voltage, which is typically 400 volts. The power conversion circuit topology in general use for strobe power supplies is the flyback converter. Flyback power converters can be operated in one of two modes: continuous conduction mode (CCM) and discontinuous conduction mode (DCM) both of which have flaws. The dead time during which no current flows in DCM causes increased peak power requirements; and CCM causes increased electromagnetic interference (EMI). Both flaws are mitigated by the use of transitional mode control. Transitional mode eliminates the power loss caused by the dead time in DCM and eliminates the radio frequency interference associated with CCM. Transitional mode control requires that the power-switching transistor be turned on immediately upon the cessation of stored magnetic energy in the flyback transformer. Transitional mode control also requires the power switching frequency to vary in response to variations in system parameters and operating conditions.

When the power requirements are for substantially more than 60-watts, it is generally more efficient to split the power between two power converters. It has been found that operating dual power converters by providing switching cycles for the two converters that are out of phase by 180-degrees enhances efficiency and reduces EMI. However, with transitional mode control, each converter sets its own switching frequency in response to the cessation of magnetic energy in its flyback transformer. It is generally impractical to expect that two transitional mode power converters will operate at exactly the same frequency. Imbalances in the converters inevitably result in phase drift. Therefore, it is desirable to have a method of synchronizing two flyback power converters operating in transitional mode to maintain 180-degrees of phase displacement between the switching cycles of the two converters.

A typical emergency vehicle has a vehicle battery that must supply power to more than one flash tube using more than one output from a strobe power supply. Each output from the strobe power supply connects to one flash tube. In general, flash tubes are not usually flashed simultaneously. A flash pattern can provide that tubes be flashed sequentially, partially simultaneously or in different combination patterns. In one pattern, for example, half of the tubes are flashed simultaneously with a rapid series of light impulses and then the same rapid series of light impulses from the other half of the tubes takes place. The combinations and sequences change the flash pattern.

Referring now to FIG. 1A of the drawings, an illustrative signaling system having a power supply 10 in accordance with the present invention is shown installed in an emergency vehicle 12 (in broken lines). The illustrated signaling system includes a plurality of signaling devices 14, in this case strobe lights, which are mounted to the vehicle 12. In the illustrated embodiment, each of the strobe lights 14 is connected via a respective cable 16 to a common power supply 10. In a related application, a cable management system and a cover for a power supply are disclosed. The application is copending U.S. patent application Ser. No. 10/280,192, Attorney Docket No. 218010, filed on Oct. 25, 2002, and entitled "Cable Management System and Protective Cover For A Remote Power Supply" with inventors Myron Pavlacka and Manny Magana, and is incorporated herein by reference for all purposes. Although the power supply 10 is shown mounted in the trunk of the vehicle 12, it may be mounted elsewhere such as for example under the dashboard in the passenger compartment of the vehicle. The power supply 10 is, in turn, connected to the vehicle battery 18. The power supply 10 conditions power from the vehicle battery 18 in order to produce light flashes in the individual strobe lights 14. Additionally, the power supply 10 also controls the power distribution to the individual strobe lights 14 in the signaling system so as to allow for the production of different flash patterns across the plurality of strobe lights 14.

Strobe lights 14 produce a flash of light by discharging a capacitor into a tube filled at low pressure with xenon gas. Power supply 10 triggers the flash and charges the flash capacitor. To charge the capacitor, strobe lights typically implement a DC-to-DC flyback type power converter. When the average power exceeds 60-watts, efficient systems typically implement dual flyback converters.

Figure 1B:
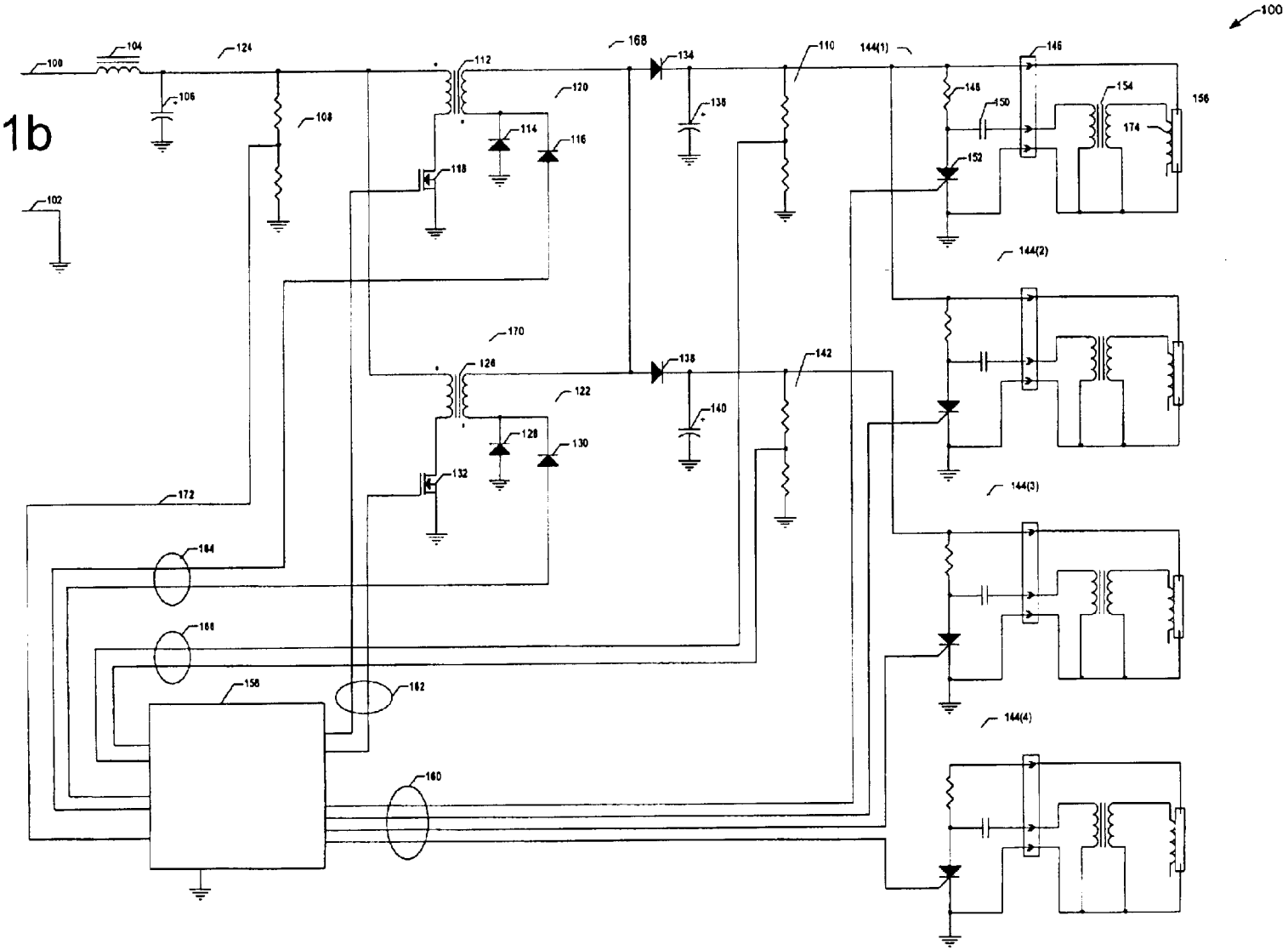
FIG. 1B is a simplified schematic diagram of a dual power converter in accordance with an embodiment of the present invention.

Referring to FIG. 1B, a dual flyback converter system 100 is shown. The dual flyback converter system 100 includes flyback converters 168 and 170, which charge flash capacitors 136 and 140 from a vehicle battery connected to terminals 100 and 102. The system 100 also includes input filter 124, shown as including inductor 104 and capacitor 106 that smooth the current demand on the battery. Other input filter configurations that use other smoothing components are also within the scope of this disclosure. Control circuit 158 can be implemented as a microcontroller having a resident program to fully control the dual flyback converter as well as the flash patterns. Control circuit 158 is shown having outputs 162 that carry signals to control a DC-to-DC power conversion process by supplying transistors 118 and 132 with a switching cycle. Control circuit 158 is also shown with outputs 160 that carry signals to individually trigger a plurality of strobe tubes typified by strobe tube 156. Modules 144(1,2,3,4) contain circuitry configured to provide individual triggering for each of at least four strobe tubes. In one embodiment, to trigger strobe tube 156, control circuit 158 sends a trigger signal on the appropriate output of 160 to SCR device 152, triggering device 152 into the conducting state. Capacitor 150 then discharges through SCR 152, the connector 146 and the primary winding of trigger transformer 154. Trigger transformer 154 then provides a high voltage pulse to the trigger wire 174, triggering strobe tube 156 to flash. Although four modules are shown, the actual number depends on the application requirements. Control circuit 158 is shown with several inputs 172,164, and 166. The power supply input voltage at terminals 100 and 102 is scaled down by voltage divider 108 and applied as input 172 to control circuit 158. The voltages across flash energy storage capacitors 136 and 140 are scaled down by voltage dividers 110 and 142 and applied as inputs 166 to control circuit 158. Inputs 172, 164 and 166 are analog voltages that are converted to binary numbers by an analog-to-digital converter contained within control circuit 158. The data is then stored in memory locations within control circuit 158 and periodically updated. The resident program refers to the stored data to do one or more of maintain control of the on-time interval for transistors 118 and 132; maintain control of the voltage across flash capacitors 136 and 140; implement the neoning detection/correction and diagnostic sequence of an embodiment; and form a flash pattern by triggering the flash tube modules 144(1,2,3,4) with various patterns stored in the resident program.

Transitional mode of operation for a flyback power converter occurs when, during each switching cycle, the power-switching transistor is turned on immediately upon the cessation of stored energy in the flyback transformer. Transitional mode is beneficial in the reduction of EMI. According to an embodiment, transitional mode control is implemented via identifying the cessation of secondary winding current by sensing the voltage drop across rectifying diode 114 or 128, which are shown connected in series with the secondary winding of the flyback transformer, either 112 or 126, respectively. The control circuit input 164 represents a secondary current sense signal. When the secondary current falls to zero, the diode (either 114 or 128) voltage reverses. The voltage reversal triggers control circuit 158 to turn on the corresponding transistor (either 118 or 132) immediately, diminishing the dead time to a negligible amount under all operating conditions. Diodes 116 and 130 prevent the high voltage at transformers 112 and 126 from damaging control circuit 158.

It is known to operate dual power converters with switching cycles out of phase by 180-degrees. The 180 degree phase relationship minimizes input and output ripple, and improves efficiency and reduces EMI. With transitional mode control however, each converter sets its own switching frequency in response to the cessation of magnetic energy in its flyback transformer. Furthermore, the frequency continually increases as the flash capacitor charges up. Even though the converters may be constructed with nearly identical components, it is improbable that two transitional mode power converters would operate at exactly the same frequency and maintain their phase relationship. Prior art methods fail to maintain a fixed phase relationship between two transitional mode converters.

An embodiment is directed to a method for synchronizing two flyback power converters operating in transitional mode to maintain 180-degrees of phase displacement between the switching cycles of the two converters. First, the two converters are constructed with nearly identical components so that, ideally, the two converters have identical free running frequencies and the synchronization function has no effect. In practice, however, it is unlikely that two converters will have identical free running frequencies. To synchronize the two frequencies and maintain a phase displacement of 180-degrees, a small dead time is introduced to the converter whose free running frequency happens to be the higher of the two frequencies. The synchronization method according to an embodiment introduces only enough dead time to the higher frequency converter to reduce the frequency so that the frequency matches the other converter and maintains the 180-degree phase displacement between the converters.

Figure 2:
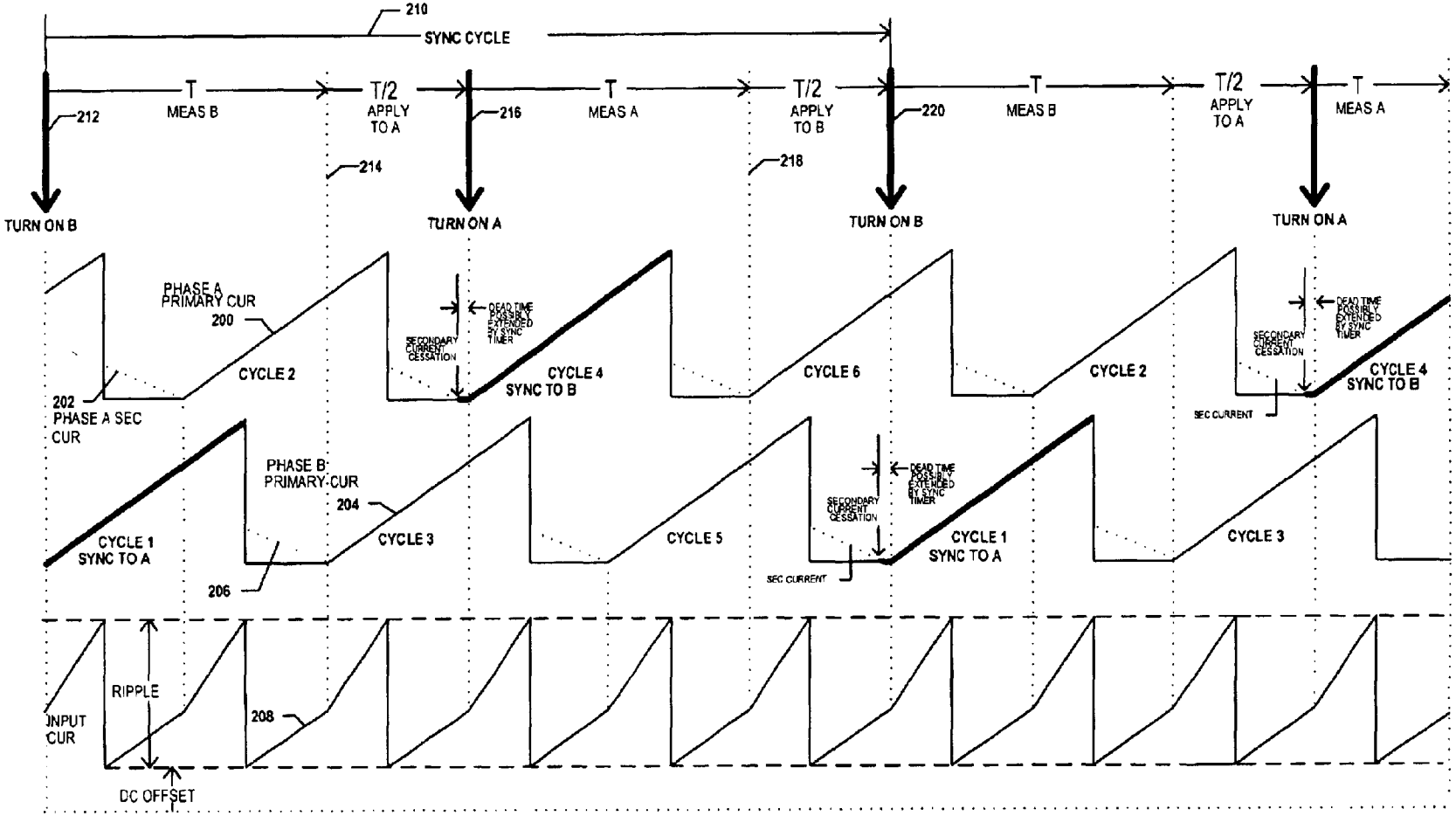
FIG. 2 is a graph illustrating waveforms of phase cycles illustrating a method for synchronizing the phases in a dual converter power supply in accordance with an embodiment of the present invention.

With reference to FIG. 2, the flyback transformer primary current waveform 200 and the secondary current waveform 202 for phase A are shown along with the primary current waveform 204 and the secondary current waveform 206 for phase B. The summation current waveform 208 of the two primary current waves is also shown. The phases are adjusted to a displacement of 180-degrees every fourth cycle of each phase. The cycles that have synchronization applied are drawn with bold lines. A complete synchronization cycle 210 takes 6-converter cycles, labeled CYCLE 1 through CYCLE 6. The Phase Synchronization Function operates as follows. A timer measures the period of phase B starting from the turn on of the B power transistor at 212 and ending with the next turn on of the same transistor at 214. The measurement is then divided by two to obtain the half-period for phase B (corresponding to 180-degrees). The Synchronization Function waits the half-period beginning with transistor B turn-on at 214 and then issues a turn on command to the phase A transistor at 216. This sync turn on command is AND-ed with the normal turn on command for that transistor. The normal turn on command occurs at the cessation of secondary current. The AND-ing of two sustained turn-on commands results in the first command being ignored while the later command results in the actual turn-on. If the sync turn-on command occurs ahead of the normal turn on command, then the transistor will turn on exactly when it normally would without the sync (the sync is ignored). In that case, the sync has absolutely no effect on the phase. However, if the sync turn-on command arrives anytime after the normal turn-on command, then the sync will be effective in turning on the phase. Stated another way, a phase can be retarded by the Synchronization Function but cannot be advanced. In other words, a phase can have its frequency lowered by the Synchronization Function but cannot have its frequency raised. To guarantee that the logic will always work, the roles of the measured and sync-applied phases are alternated. That way, the phase with the higher free running frequency will always be corrected. Thus, beginning at 216, a timer measures the period of phase A starting from the turn on of the A power transistor at 216 and ending with the next turn on of the same transistor at 218. This measurement is divided by 2 to obtain the half-period for phase A (corresponds to 180-degrees). The Synchronization Function waits the half-period beginning with transistor A turn-on at 218 and then issues a turn on command to the phase B transistor at 220. The sync turn on command is AND-ed with the normal turn on command for that transistor. After the sync turn on command is AND-ed with the normal turn on command, the synchronization cycle consisting of 6-converter cycles is complete.

Figure 3:
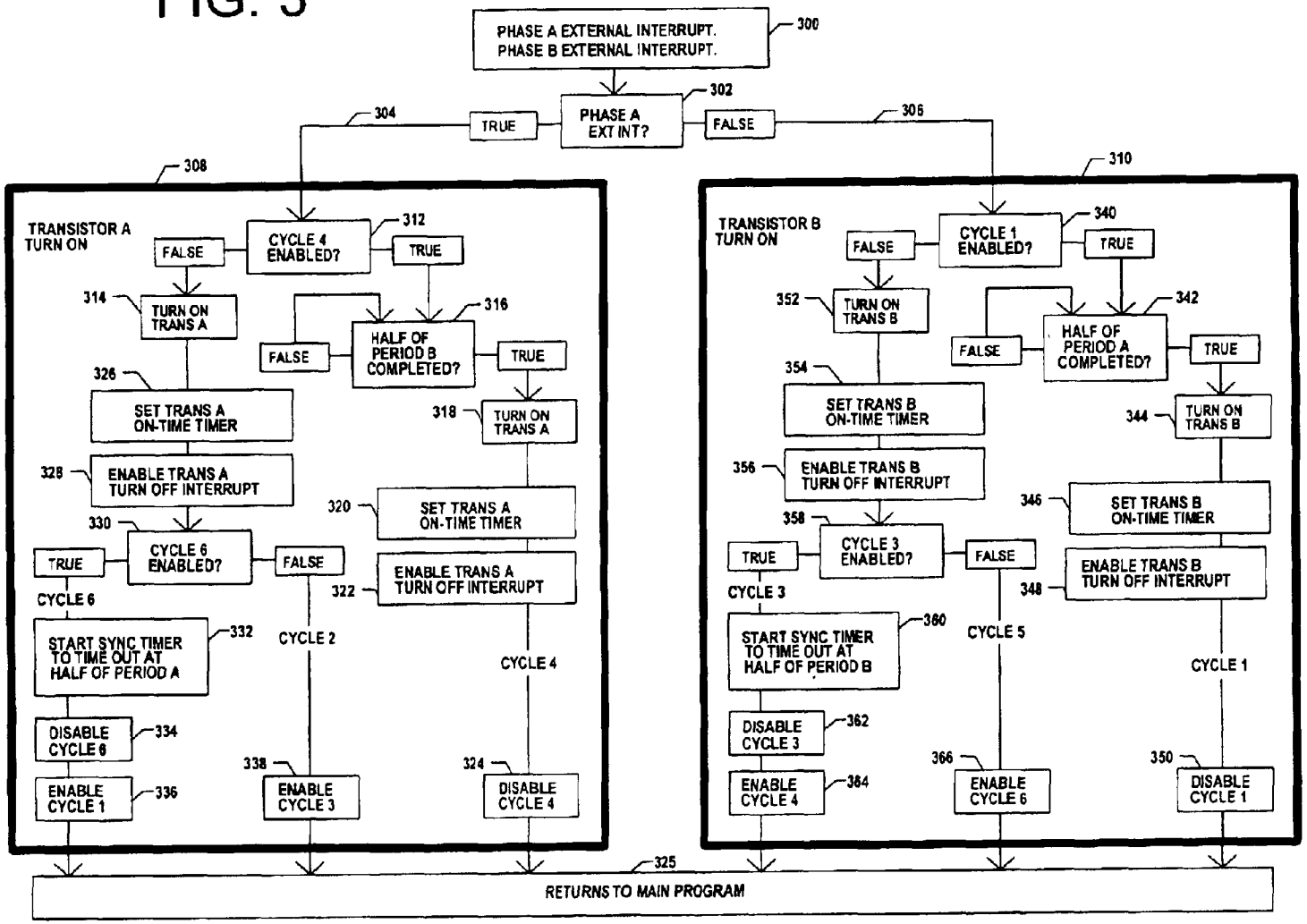
FIG. 3 is a flow diagram illustrating a method for synchronizing the phases in a dual converter power supply in accordance with an embodiment of the present invention.

The flow diagram of FIG. 3 illustrates an embodiment of a method for forming the six power converter cycles of the synchronization cycle shown in FIG. 2. The logic of FIG. 3 can be implemented as an external interrupt service routine. There are two external interrupts that transfer control to the top of the flow diagram at block 300. The first external interrupt occurs at the cessation of secondary current for the first flyback power converter (the phase A converter) while the second external interrupt occurs at the cessation of secondary current for the second flyback power converter (the phase B converter). If an external interrupt is due to the cessation of current in phase A, then block 302 transfers control to major block 308 via line 304. Block 312 determines if CYCLE 4 is enabled. In either case, the A-phase transistor is turned on in either block 314 or block 318. If an external interrupt is due to the cessation of current in phase B, then block 302 transfers control to major block 310. Block 340 determines whether CYCLE 1 is enabled. In either case, the B-phase transistor is turned on in either block 352 or block 344.

In block 308, after transistor A is turned on in block 314, block 326 provides for setting transistor A on-time timer, followed by block 328 enabling transistor A turn off interrupt.

After block 318 turns on transistor A, block 320 sets transistor A's on-time timer, followed by block 322 enabling transistor A's turn off interrupt. Block 324 provides for disabling CYCLE 4, followed by a return to a main program 325.

There are six paths through the diagram of FIG. 3 labeled CYCLE 1 through CYCLE 6 corresponding to phase cycles labeled CYCLE 1 through CYCLE 6 in FIG. 2. Although each path is indicated by just one label, that label refers to the complete path starting from block 300 and ending at block 325. When control exits the path labeled CYCLE 6 in FIG. 3, the actions that were taken along that path from top to bottom of the diagram result in the turn on of transistor A in block 314 to begin the formation of phase CYCLE 6 in FIG. 2. Control is steered to a particular path in FIG. 3 depending upon two logical variables: the two mentioned external interrupts and a flags variable. As an example of path steering by the flags variable, assume that the CYCLE 6 path is being executed. A true determination from block 330 causes, in block 332, a start sync timer to time out at half of period A. If a false determination is made, CYCLE 2 is executing and block 338 enables CYCLE 3 followed by a return to the main program 325. If true, block 334 resets the CYCLE 6 flag to disable the CYCLE 6 path while block 336 sets the CYCLE 1 flag to enable the CYCLE 1 path. When the next external interrupt occurs due to the cessation of current in the phase B power converter, block 302 will steer control to major block 310 via line 306. Then the flags variable will be tested in block 340 and control will be steered to block 342 or block 352 depending on whether the CYCLE 1 flag is enabled. If CYCLE 1 flag is enabled, block 342 determines if half of a period A is completed. If so, block 344 turns on transistor B. Next block 346 sets transistor B's on-time timer. Block 348 enables transistor B's turn off interrupt. Block 350 provides for disabling CYCLE 1 followed by a return to the main program 325. If Block 352 turns on transistor B, block 354 sets transistor B's on-time timer. Next, block 356 enables transistor B's turn off interrupt. Block 358 provides for determining whether CYCLE 3 is enabled. If so, block 360 starts a sync timer to time out at half of period B, followed by block 362 disabling cycle 3 and block 364 enabling cycle 4, followed by a return to the main program 325. If CYCLE 3 is not enabled in block 358, a false determination is made, and block 366 enables CYCLE 6, followed by a return to the main program 325.

Referring back to FIG. 1B, according to an embodiment, charging current into the flash capacitor is held off for a sufficient time immediately following a flash. Otherwise, the flash tube will continue to conduct, thereby diverting the charging current and preventing the capacitor from charging and disabling the entire strobe power supply. A continuously conducting tube glows dimly, like a neon tube, and the fault condition is known as "neoning". There are two anti-neon methods practiced in the prior art. In the first prior art method a time delay means is used to hold off charge current for a fixed interval immediately following a flash thereby allowing time for the capacitor to discharge and the tube to extinguish. The fixed time delay anti-neon solution suffers from non-adaptability to strobe tube variances. For example, as gas pressure decreases with age due to an imperfect seal, the delay needed for tube extinction increases. In the second prior art anti-neon method, a parallel-connected resistor/diode is placed in series with the flash tube and the resistor voltage drop is sensed (the forward-biased diode limits the resistor voltage drop). The charge current is held off until the sensed voltage falls below a threshold, indicating that the tube current has fallen below a corresponding threshold. The prior art solution assumes that the tube will continue to turn off even though charge current is turned on prior to the absolute cessation of tube current or following some arbitrary delay subsequent to falling below the threshold. The assumption may not be absolutely valid so that a probability of neon-ing still exists.

Instead of trying to measure or predict the instant that the strobe tubes turn off following a flash, one embodiment disclosed herein learns the delay that is actually needed. Referring back to FIG. 1B, at power-up, a value is assigned in a resident program the control circuit 158 to an anti-neon off-time delay variable that is known to be adequate for the mean (of the tube population) to avoid the neon state. The value initially assigned to the variable can be determined by testing. Then, following each flash, approximately 10-milliseconds after the charge current is turned on; the program within control circuit 158 "looks" at the flash storage capacitors, 136 and 140 voltages to determine if either has risen as compared to a reference measurement, such as a constant, a prior measurement, or an appropriate reference according to designer choice. If a prior measurement is used, one embodiment requires that the measurement be taken just before the charge current is turned on by the control circuit 158. The mentioned 10-millisecond interval is normally time sufficient for the flash energy storage capacitors 136 and 140 to undergo significant voltage rise in the absence of any neoning tube. If capacitor voltage has not significantly increased during 10 mS of charging, the program "assumes" that neoning is taking place. The assumption is normally valid because a neoning tube will sharply limit the voltage to the ionization voltage of the gas. In general, the ionization voltage of the tube is approximately equal to the capacitor voltage after a normal flash (30-volts), and the capacitor voltage will rise significantly (to above 60-volts) during 10-milliseconds of charge current if neoning is not taking place. On the other hand, if neoning occurs when charge current is turned on, the capacitor voltage will have virtually no rise and usually falls (slightly) under the influence of the enhanced ionization produced by the current. Therefore, referring to FIG. 1B, a small change in the flash energy storage capacitors 136 and 140 voltage 10 mS after charge current is turned on following a flash is a reliable indicator of neoning. The result forms the basis for the neoning detection/correction and diagnostic sequence methods according to embodiments herein.

When neoning is detected, programs within control circuit 158 respond in two ways. First, the value stored in the mentioned anti-neon off-time delay variable is incremented (usually, by about 10%). Then the charge current output lines 162 is immediately turned off by control circuit 158 for the newly incremented off time after which the charge current is turned back on. After charge current has been flowing for another 10-milliseconds, the flash capacitors 136 and 140 voltages are again tested. If either of the flash capacitor voltages fail to increase, neoning persists; the value stored in the mentioned anti-neon off-time delay variable is again incremented; and the charge current via output lines 162 again is turned off for the newly incremented delay interval. The cycle of charge/test/turn-off with incremented delay, is repeated until finally the test is passed (the capacitor voltage rises) and the program "learns" the delay that is actually needed (within one increment). The new delay time is then applied after subsequent flashes. The neoning detection and correction method described above can be run after every flash and additional delay is added to the anti-neon off-time delay variable as needed. As a tube loses gas pressure due to age, temperature cycling and an imperfect seal, the propensity to neoning increases and the delay must be increased. A tube is considered defective if it demands an anti-neon off-time delay beyond some limit. A predetermined upper limit is placed on the delay and if this limit is reached, a diagnostic sequence is performed to identify defective tubes and effectively remove them by inhibiting their trigger pulses.

Figure 4:
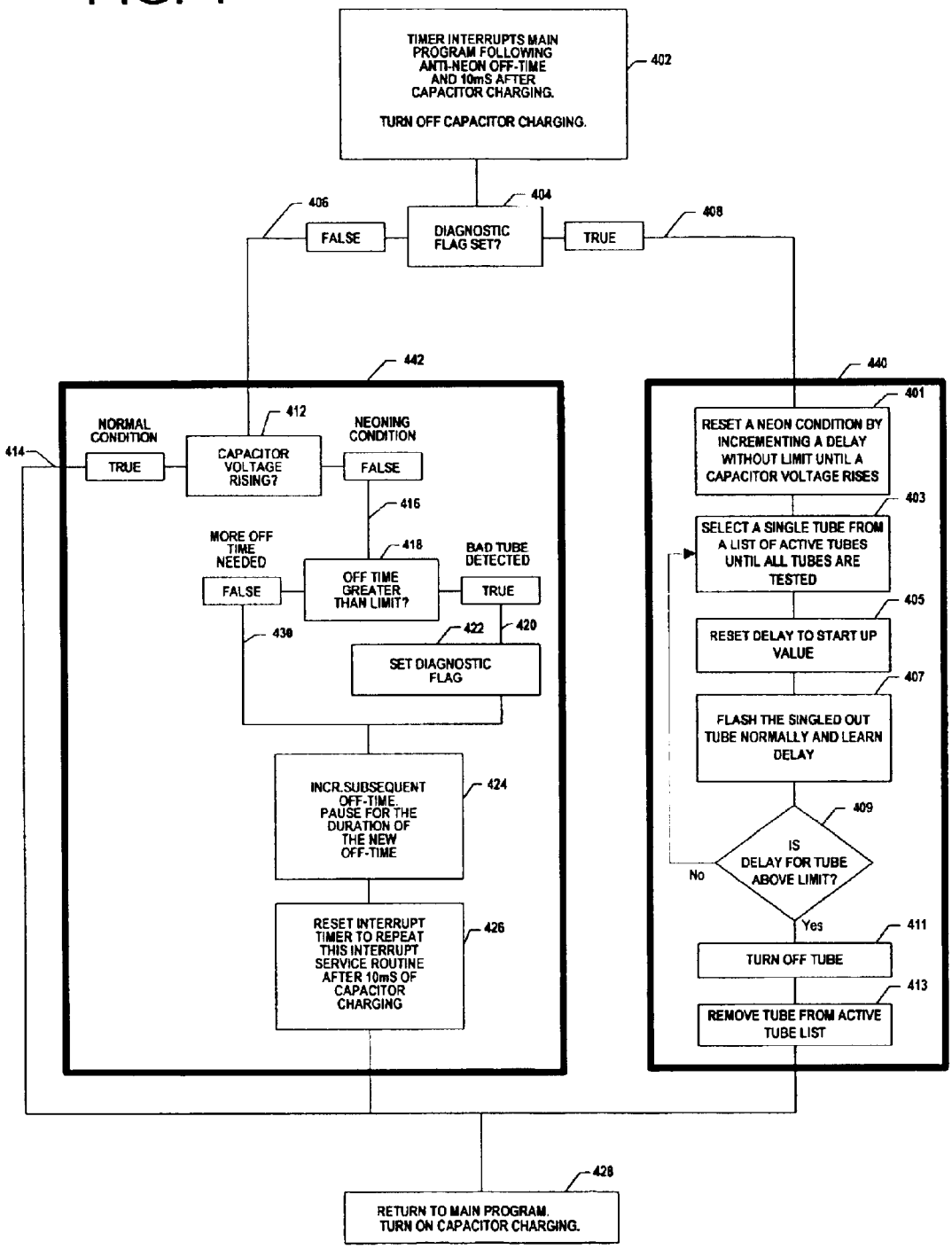
FIG. 4 is a flow diagram illustrating a neoning detection/correction method in accordance with an embodiment of the present invention.

Referring to FIG. 4, a flow chart illustrates the description just given above for the neon detection/correction method. The logic that is shown in FIG. 4 can be implemented as an interrupt service routine (ISR) within a program of control circuit 158. Block 402 provides for a program interrupt by a peripheral timer. The timer is set to interrupt the main program and shut off capacitor charging after 10-milliseconds of capacitor charging following the anti-neon off-time delay for every flash. Block 404 provides for the ISR to take one of two pathways: path 406 or 408. Path 406 is taken if the diagnostic flag was not set in block 422 during the immediately prior pass through the ISR. Path 406 causes entry to block 442. In one embodiment, block 442 represents a normal path. Block 412, the first block in the normal path, provides for the ISR to take one of two pathways: path 414 or 416. Path 414 is the normal path, taken when a neon fault state is not detected by block 412. Path 414 returns control to the main program without taking any action. Block 428 provides for a return to the main program and for capacitor charging to be turned back on. When the normal path 414 is followed, the timer interrupt does not occur until the next flash. Path 416 is taken when block 412 detects that a neon fault state exists. Block 418 provides for the ISR to take one of two pathways: path 430 or 420. Path 430 is the usual path, taken when block 418 determines that the anti-neon delay has not yet reached a predetermined limit. Path 420 is taken when block 418 determines that the anti-neon delay has reached the limit; in which case, the diagnostic flag is set in block 422. Both paths then converge in block 424 in which the off-time variable is incremented and the ISR pauses for the duration of the new off time. Following the delay, block 426 provides for the reset of the timer and to interrupt again and repeat the ISR of FIG. 4 after 10 mS of capacitor charging in the main program. Finally, block 428 provides for returning control to the main program and turning capacitor charging back on. When the diagnostic flag is set in block 422 as a result of the off time exceeding the limit, the next timer interrupt (e.g., 10 mS after capacitor charging in the main program), results in control branching to path 408 and block 440 where the diagnostic sequence is executed.

The diagnostic sequence of block 440 provides for first resetting a neon condition by incrementing a delay without limit until the capacitor voltage rises in block 401. Then, a single tube to be tested is selected in block 403 and the delay reset to the start up value in block 405. The singled out tube is flashed normally and the delay needed for this tube is learned in block 407. In block 409, the method determines whether the delay needed for the singled out tube is above the limit. If so, then the tube is turned off in block 411 and removed from a list of active tubes in block 413. If the singled-out tube passes the test in block 409, then another tube is selected and tested in block 403. Eventually, either the defective tube is found and shut down or all tubes pass the test. The tubes remaining on the active list are then restored to service and the delay reset to the start up value. Having all tubes pass the test in spite of a detected failure is likely to occur since the neon failure mode is not exactly repeatable. However, as the condition worsens, the defective tube will eventually be shut down. The delay needed for the reduced group of tubes is learned in block 407 and stored in a programmable control circuit such as programmable control circuit 158 shown in FIG. 1B. When the power supply undergoes a power down/up cycle, all tubes are restored to operation and the anti-neon off-time variable is reset to the initial value.

Figure 5:
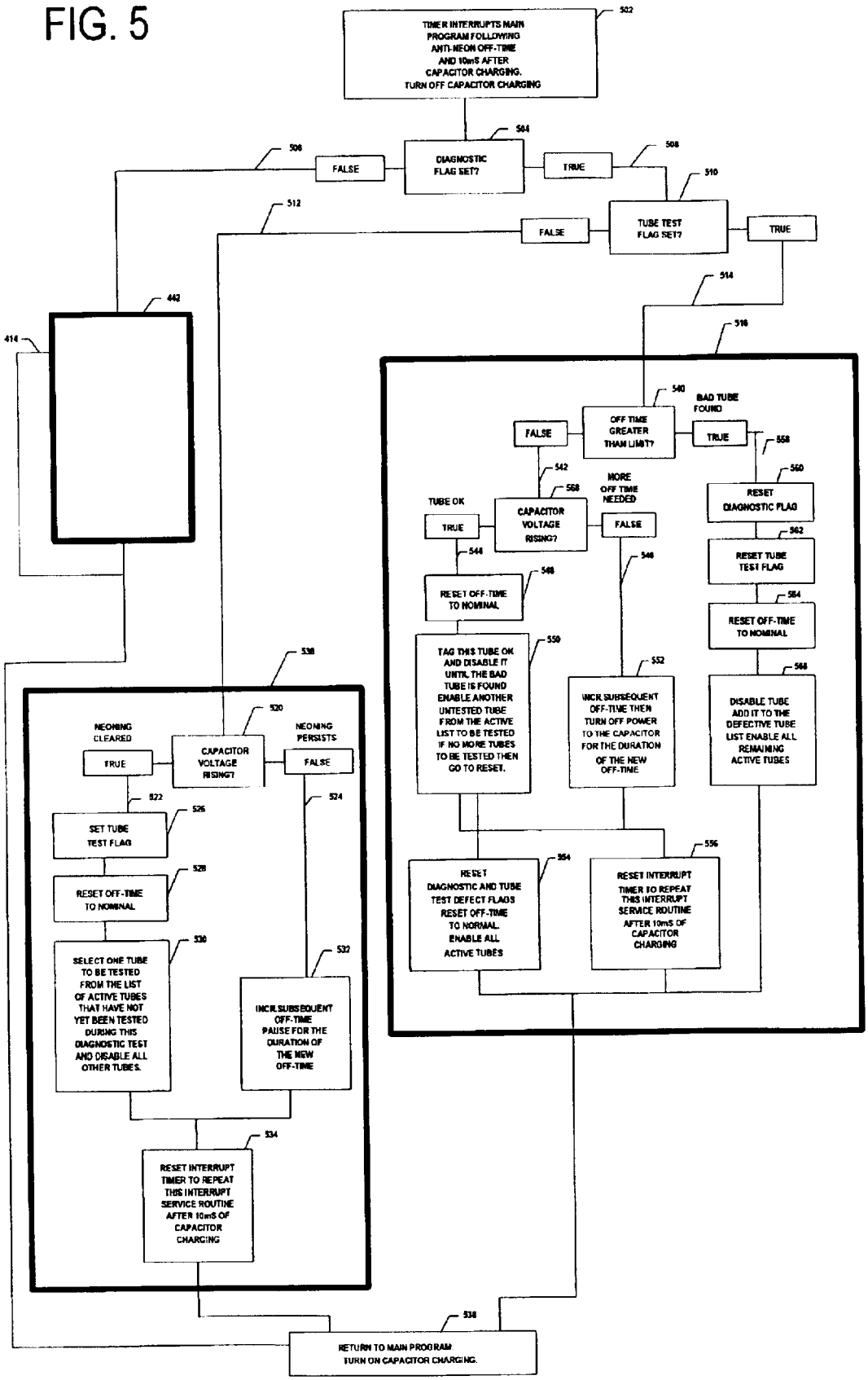
FIG. 5 is a flow diagram illustrating a method for performing a diagnostic sequence in accordance with an embodiment of the present invention.

Referring to FIG. 5, a flow diagram describes the diagnostic sequence in more detail. The logic that is illustrated in FIG. 5 is implemented as an interrupt service routine (ISR) within the program of control circuit 158. The ISR of FIG. 5 and the ISR of FIG. 5 and the ISR of FIG. 4 can be one and the same. As in FIG. 4, block 502 provides for program interrupts by a peripheral timer. The timer is set to interrupt the main program and shut off capacitor charging after 10-milliseconds of capacitor charging following the anti-neon off-time delay for every flash. Block 504 provides for the ISR to take one of two major pathways: path 506 or 508. Path 506 is taken when the diagnostic flag was not set in neoning detection/correction block 442 during the preceding pass through the ISR. Assuming that the diagnostic flag is set upon entry into the ISR, block 504 provides for control to branch to block 510. Block 510 then provides for the ISR to take one of two pathways (512 or 514) depending upon the state of the tube test flag. On the first entry into the diagnostic sequence (diagnostic flag set), the tube test flag is not set and block 510 provides for control to branch to major block 538. The first function of major block 538 is to quickly clear a neoning state (should such state persist) by incrementing the anti-neon off-time delay without limit and with much larger increments than in the detection/correction block 442. The second (and last) function of major block 538 is to select a single tube to be tested and set the tube test flag. Block 520 provides for major block 538 to take one of two pathways: path 522 or 524. Path 524 is taken if the neoning state is detected in block 520 and control proceeds to block 532 in which the anti-neon off-time delay variable is incremented (by a large amount) and the ISR pauses for the duration of the new off time. Following the delay, block 534 provides for the reset of the timer to interrupt again and repeat the ISR of FIG. 5 after 10 mS of capacitor charging in the main program. Finally, block 536 returns control to the main program where capacitor charging resumes for 10 mS until the timer interrupt occurs. When the neoning state is cleared: on the next interrupt, block 520 provides for control to branch to path 522 and block 526 in which the tube test flag is set. Then, the anti-neon off-time delay is reset to the initial (power-up) value in block 528 and a tube to be tested is selected in block 530. The selection is made on the basis of two criteria: first, the tube must be active (not have failed previously); second, the tube must not have already been tested during the current diagnostic sequence. After tube selection, control transfers to block 534 in which the interrupt timer is reset to repeat the diagnostic sequence after 10 mS of capacitor charging. Finally, block 536 returns control to the main program where capacitor charging resumes for 10 mS until the timer interrupt occurs. When this next interrupt occurs, the tube test flag will have been set in block 526 so that the ISR branches to major block 516 where the tube selected in block 530 is tested.

Block 540 provides for major block 516 to take one of two major pathways: path 542 or 558. On first entry into major block 516, the anti-neon off-time delay will not be above limit (off-time is reset in block 528 during the prior pass through the ISR) so that block 540 transfers control to path 542. Then, if a neoning state is detected in block 568, control is transferred to path 546 and block 552 in which the anti-neon off-time delay variable is incremented and the program waits for the duration of the new off time. At the end of the off time, block 556 resets the interrupt timer to repeat the interrupt after 10-milliseconds of capacitor charging. Control is then returned to the main program in block 536. If a neoning state is not detected in block 568 then control is transferred to path 544 and block 548 in which the off-time variable is reset to the start up value. Then block 550 tags the tube OK and disables the tube until the bad tube is found. Then another tube is selected to be tested from the active list of tubes that have not yet been tested. Control then transfers to block 556 and then block 536. If no more tubes exist to be tested, then control is transferred to block 554 in which the system is restored to normal. If, during any re-entry into block 516, the off-time variable exceeds the limit, block 540 transfers control to path 558 and then to blocks 560, 562, and 564 in which diagnostic flag is reset, the tube test flag is reset and the off-time variable is reset to the start up value. Then, the tube is disabled by having its trigger signal inhibited in block 566. Block 566 then enables all remaining active tubes before returning to the main program at block 536.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A flash strobe power supply comprising:

an input filter;

a control circuit coupled to the input filter;

a first and second transistor operatively coupled to the control circuit;

a first and second transformer, each transformer operatively coupled to at least one of the first and second transistors; and at least two circuits configured to sense an energy state of each transformer, the circuits coupled to the programmable control circuit, the control circuit configured to operate each transistor in response to at least one of the circuits to allow a dead time between cessation of energy in each transformer and an associated transistor turn on via synchronization code in the control circuit, the synchronization code periodically delaying operation of one or the other of the first and second transistors to maintain a 180 degree phase difference in switching cycles of the first and second transistors.

2. The flash strobe power supply of claim 1 wherein the control circuit is configured to provide switching cycle signals to the first and second transistors, the switching cycle signals according to a logical function applied to a combination of turn on commands, the logical function providing for a later command of a measured synchronizing turn on and a normal turn on for the first transistor to be an operative turn on, the later operative command enabling synchronization of the turn on of the first transistor with a turn on of the second transistor.

3. The strobe power supply of claim 2 wherein the logical function is equivalent to AND-ing of the turn on commands.

4. The strobe power supply of claim 2 further comprising:

at least two isolating circuits coupled to the programmable control circuit, each of the isolating circuits including:

a voltage divider configured to provide a voltage measurement of a flash capacitor and to provide a voltage limiting function for a flash lamp.

5. The strobe power supply of claim 2 wherein the 180 degree relationship reduces ripple current in the input filter.

6. A method for operating at least two power converters in at least two phases with transitional conduction mode for a strobe power supply, the method comprising:

determining which of the power converters has a higher frequency; and periodically introducing enough dead time to the higher frequency power converter to displace the phases of the at least two power converters by a predetermined amount to maintain a displacement in the at least two phases.

7. The method of claim 6 further comprising:

adjusting the at least two phases to a displacement of 180 degrees every fourth cycle of each phase.

8. The method of claim 6 further comprising:

measuring a period of a phase according to a time between each turn on of a transistor in at least one of the power converters; and dividing the measured period by a predetermined number.

9. The method of claim 6 wherein the phases are two current phases displaced by 180 degrees, the phases being synchronized over every six cycles of the power converters.

10. The method of claim 6 wherein a programmable control circuit applies a logical function to a combination of turn on commands, the logical function providing for a later command of a measured synchronizing turn on and a normal turn on for a first transistor to be an operative turn on, the synchronizing command enabling synchronization of the turn on of the first transistor with a turn on of a second transistor in an out of phase power converter.

11. The method of claim 10 wherein the logical function is equivalent to AND-ing.

12. The method of claim 6 wherein the periodic introduction of dead time is determined via an external interrupt service routine including a first external interrupt occurring at a cessation of secondary current for a first power converter and a second external interrupt occurring at a cessation of secondary current for a second power converter, the first and second external interrupts identifying a cycle to initiate.

13. The method of claim 12 wherein the first and second external interrupts and a flag variable determine which cycle of the at least two power converters is enabled.

14. A method for synchronizing phases of a dual power converter in a flash strobe power supply, the method comprising:

dividing a period of a first phase of the dual power converter and obtaining a predetermined fractional period of time;

waiting for the predetermined fractional period of time;

issuing a turn on command; and

AND-ing the turn on command with a turn on command for a second phase of the dual power converter.

15. The method of claim 14 wherein the predetermined fractional period of time is a half period.

16. The method of claim 14 wherein the dividing occurs every fourth cycle of each phase.

* * * * *